US005993091A

United States Patent [19]

Ishida et al.

[11] Patent Number: 5,993,091

[45] **Date of Patent: *Nov. 30, 1999**

[54] INK RIBBON FEEDER THAT EQUALIZES RIBBON TENSION OVER THE ENTIRE INK RIBBON WIDTH

[75] Inventors: Kazuhito Ishida, Ichinomiya; Hideo Nishigaki, Nagoya, both of Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/996,205

[22] Filed: Dec. 22, 1997

[30] Foreign Application Priority Data

Jan. 8, 1997 [JP] Japan ..... 9-001291

[51] Int. Cl.[6] ..... B41J 33/22

[52] U.S. Cl. ..... 400/234; 400/218; 400/236.2

[58] Field of Search ..... 400/218, 219, 400/234, 236, 236.2

[56] References Cited

U.S. PATENT DOCUMENTS

| | | | |
|---|---|---|---|
| 3,291,043 | 12/1966 | Bernard | 101/96 |
| 3,889,893 | 6/1975 | Silverman et al. | 242/420.5 |
| 4,096,417 | 6/1978 | Chambolle | 318/7 |
| 4,413,557 | 11/1983 | Wade, Jr. et al. | 400/218 |
| 4,591,283 | 5/1986 | Hilpert | 400/248 |
| 4,869,607 | 9/1989 | McAdams | 400/222 |
| 5,160,205 | 11/1992 | Mistyurik | 400/248 |
| 5,297,879 | 3/1994 | Oikawa | 400/234 |
| 5,342,131 | 8/1994 | Nakajima et al. | 400/120.01 |
| 5,593,238 | 1/1997 | Fox et al. | 400/234 |
| 5,622,440 | 4/1997 | Yamamoto et al. | 400/208 |
| 5,709,488 | 1/1998 | Imai et al. | 400/208 |
| 5,820,277 | 10/1998 | Schulte | 400/223 |

FOREIGN PATENT DOCUMENTS

| | | |
|---|---|---|
| 9-193520 | 7/1997 | Japan . |
| 1498367 | 1/1978 | United Kingdom . |

OTHER PUBLICATIONS

Patent Abstracts of Japan, Publication No. 60250976, Dec. 11, 1985.

Patent Abstracts of Japan, Publication No. 63 135276, Jul. 6, 1988.

*Primary Examiner*—Ren Yan
*Assistant Examiner*—Daniel J. Colilla
*Attorney, Agent, or Firm*—Oliff & Berridge, PLC

[57] ABSTRACT

An ink ribbon feeder wherein a feed roll support section rotatably supports an ink ribbon feed roll and a take-up roll support section rotatably supports a take-up roll support section; a first driving section turns a take-up roll to wind the ink ribbon in an ink ribbon take-up direction, and a second driving section turns the feed roll in the opposite direction of the first driving section, to apply a tension to the ink ribbon. The first driving section and the second driving section are disposed on the same side of both the take-up roll and the feed roll in the ribbon take-up direction. The recording unit, inclusive of the recording head, the ink ribbon feed roll and the take-up roll are mounted in various ways to equalize the tension over the width of the ink roller.

19 Claims, 9 Drawing Sheets

INK RIBBON FEEDER THAT EQUALIZES RIBBON TENSION OVER THE ENTIRE INK RIBBON WIDTH

BACKGROUND OF THE INVENTION

1. Field of Invention

The invention relates to an ink ribbon feed mechanism for a thermal recording type printing apparatus used in a facsimile machine and the like.

2. Description of Related Art

In a facsimile apparatus, which is but one example of a thermal recording type printing apparatus, an ink ribbon for recording is placed in the path of travel of the recording paper (generally, ordinary paper). The ink ribbon is usually wound on a feed roll and printing is performed while the ink ribbon is being taken up onto a take-up roll. The ink ribbon is held stretched between the feed roll and the take-up roll. Across the ink ribbon are oppositely arranged the recording paper and a recording head. With the heating of the recording head, the ink coated on the ink ribbon melts to be transferred onto the recording paper.

FIG. 9 is a plan view showing an ink ribbon feed mechanism used in a conventional facsimile apparatus.

In FIG. 9, an ink ribbon 51 is wound on a feed roll 52, and the leading end of the ink ribbon 51 is wound on a take-up roll 53. The take-up roll 53 turns in the direction of the arrow Y in the drawing. That is, the ink ribbon 51 advances in the direction of the arrow X in the drawing, being taken up on the take-up roll 53. The feed roll 52 and the take-up roll 53 are both supported nearly horizontally in relation to an unillustrated bottom plate of the facsimile apparatus by support frames 56A, 56B extending perpendicularly from the bottom plate.

The take-up operation of the ink ribbon 51 is effected by a friction mechanism 55 which drives the take-up roll 53. The friction mechanism 55 has a driving gear 58 which meshes with a gear 57 coaxially mounted on one end (on the right side in FIG. 9) of a spindle 53A of the take-up roll 53. To this driving gear 58 a specific driving effort is imparted. With the rotation of the driving gear 58, the take-up roll 53 turns in the direction of the arrow Y, taking up the ink ribbon 51. However, if the rotational speed of the driving gear 58 is fixed, the amount of the ink ribbon 51 taken up on the take-up roll 53 increases (namely, the take-up roll 53 taking up the ink ribbon 51 becomes larger in diameter), increasing the take-up speed of the ink ribbon 51. There occurs, therefore, a difference in rotational speed between the take-up roll 53 and an unillustrated platen roller for carrying recording paper. When a frictional force over a specific value is applied to the driving gear 58, or when the amount of the ink ribbon 51 wound on the take-up roll 53 has increased and the load to rotate the take-up roll 53 has increased over a specific value, the driving gear 58 idles to absorb the speed difference from the platen roller. The other end (the left side in FIG. 9) of the take-up roll 53 is rotatably supported on a bearing section 59 provided on a support frame 56A but no driving power is provided thereto.

Concurrently, on the left end of the feed roll 52 is provided a back tension mechanism 54. The back tension mechanism 54 has a driving gear 62 which is meshed with a gear 61 coaxially mounted on one end (the left side in FIG. 9) of a spindle 52A of the feed roll 52. A specific driving power is given to the driving gear 62. The end of the feed roller 52 on the opposite side of the back tension mechanism 54 is rotatably supported on a bearing 60 mounted on the support frame 56B, and is not provided with driving power.

With the provision of driving power to the driving gear 62, the back tension mechanism 54 gives a specific turning effort to the spindle 52A of the feed roll 52 in the direction of the arrow Z which is opposite to the direction of rotation of the take-up roll 53. Then, a force in the direction of feed (the direction of the arrow X) from the friction mechanism 55 and a force in the reverse direction (the opposite direction of the arrow X) of feed from the back tension mechanism 54 act on the ink ribbon 51.

As the friction mechanism 55 and the back tension mechanism 54 operate, the ink ribbon 51 is held with a fixed tension between the feed roll 52 and the take-up roll 53, thereby preventing the ink ribbon 51 from being broken and going slack.

In the conventional ink ribbon feed mechanism, however, the friction mechanism 55 and the back tension mechanism 54 are positioned on opposite sides, in the direction of travel (the direction of the arrow X), of the ink ribbon 51. That is, as shown in the plan view of FIG. 9, the friction mechanism 55 and the back tension mechanism 54 are arranged in diagonal positions of the wide ink ribbon 51. For example, the friction mechanism 55 is disposed on the right side, while the back tension mechanism 54 is on the left side. Therefore, when the ink ribbon 51 is taken up, the driving power from the friction mechanism 55 for taking up the ink ribbon 51 and the driving power from the back tension mechanism 54 are on the opposite end of the ink ribbon 51 and a twisting force is applied to the ink ribbon 51, producing a crease in the ink ribbon 51. A crease, if found in the ink ribbon 51, deteriorates or destabilizes the print quality.

Furthermore, since the driving mechanism and the gear mechanism are disposed on opposite sides of the ink ribbon 51, the ink ribbon feed mechanism itself increases in width. This destroys the goal of saving space.

SUMMARY OF THE INVENTION

In view of the above-described problems, it is an object of the invention to provide an ink ribbon feeder of a facsimile apparatus which is capable of stabilizing print quality by eliminating crease and slack in an ink ribbon and also miniaturizes the apparatus and reduces the cost.

To solve the aforesaid problems, the ink ribbon feeder of the first embodiment comprises a feed roll support section for rotatably supporting a feed roll wound with an ink ribbon, a take-up roll support section for rotatably supporting a take-up roll for taking up the ink ribbon, a first driving section for turning the take-up roll, provided on one end of the take-up roll, for taking up the ink ribbon in the ink ribbon take-up direction from the feed roll onto the take-up roll, and a second driving section for turning the feed roll in the opposite direction of the take-up roll. The second driving section is provided at one of both ends of the take-up roll, on the same side as the first driving section in the ink ribbon take-up direction.

According to the ink ribbon feeder of the above-described structure, the first driving section and the second driving section are both disposed on the same side in the direction in which the ribbon is taken up. Therefore no twisting force will be applied to the ink ribbon, which can be prevented from creasing, thereby stabilizing the print quality. Also, since the mechanisms of the first and second driving sections can be arranged on the same side, a space savings can be realized, thus enabling miniaturization and cost reduction of the feeder.

The ink ribbon feeder of the second embodiment is further provided with a recording unit contacting the ink ribbon from below between the feed roll and the take-up roll, and a support frame for supporting the recording unit. The support frame comprises a first support section supporting one of both ends of the recording unit on the side on which the first and second driving sections are provided, and a second support section supporting the opposite end of the first support section of the recording unit at a higher position than the first support section.

According to the ink ribbon feeder of the second embodiment, the recording unit contacts the ink ribbon at a higher level than the side on which the first and second driving sections are disposed, on the side on which the first and second driving sections are not provided, to make up for an insufficient tension of the ink ribbon on the side on which the first and second driving sections are not provided. Thus the ink ribbon tension has essentially a uniform tension applied, thereby preventing the occurrence of ink ribbon creases and stabilizing the print quality.

In the ink ribbon feeder of the third embodiment the take-up roll support section and the feed roll support section are unitarily formed with the support frame. Thus, the take-up roll, the feed roll, the first support section, and the second support section are supported as one body on the support frame, enabling miniaturization and cost reduction of a support section supporting each member.

In the ink ribbon feeder of the fourth embodiment, the first support section is a vertical plate-like member supporting the recording unit at the first level, and the second support section is a vertical plate-like member supporting the recording unit at the second level which is higher than the first level. The first support section and the second support section, therefore, can be provided by plate-like members, allowing easy manufacture of the support frame and savings in mounting space for the feeder.

In the ink ribbon feeder of the fifth embodiment, the first support section is a plate-like member having screw holes for securing by screws the recording unit at the first level, and the second support section is composed of a plate-like member, and a spacer disposed between the screw holes and recording unit mounting screw holes.

Therefore, because the second support section is part of the same plate-like member as the first support section, and a spacer, a common member is usable for both the first support section and the second support section, thus reducing the cost.

In the ink ribbon feeder of the sixth embodiment, the feed roll support section has a first support section supporting one end of the feed roll on the second driving section side, and a second support section supporting the other end of the feed roll; the take-up roll support section has a third support section supporting one end of the take-up roll on the first driving section side and a fourth support section supporting the other end of the take-up roll. Between the second support section and the fourth support section is provided a longer distance than the distance between the first support section and the third support section.

According to the ink ribbon feeder structured as described above, the distance between the feed roll and the take-up roll on the second support section and the fourth support section side, that is, on the side on which no driving section is provided, is longer than the distance on the first support section and the third support section side, that is, on the side on which the driving section is provided, and adding to the ink ribbon as much increased tension as the longer part of the distance. Therefore, it is possible to correct the tension so as to decrease a tension difference between both ends of the ink ribbon, thereby preventing the ink ribbon from creasing and going slack and consequently improving the print quality.

BRIEF DESCRIPTION OF THE DRAWINGS

Preferred embodiments of the invention will be described in detail with reference to the following figures, wherein.

DETAILED DESCRIPTION OF PREFERRED EMBODIMENTS

Hereinafter preferred embodiments of an ink ribbon feeder according to the invention will be explained with reference to the accompanying drawings.

An ink ribbon feeder 10 in the facsimile apparatus of the first embodiment will be explained with reference to FIGS. 1 to 4.

An ink ribbon 1 is formed as a long medium having a width of about 218 mm which is capable of printing on an A4-size recording paper. One end of the ink ribbon 1 is wound on a feed roll 2, while the other end, on a take-up roll 3. A new ribbon 1 is fed out from the feed roll 2, advancing in the direction of the arrow A, in FIG. 1, with a predetermined tension between the feed roll 2 and the take-up roll 3, thus being used in printing. The ink ribbon 1 that has been used in printing is taken up onto the take-up roll 3.

Figure 4:
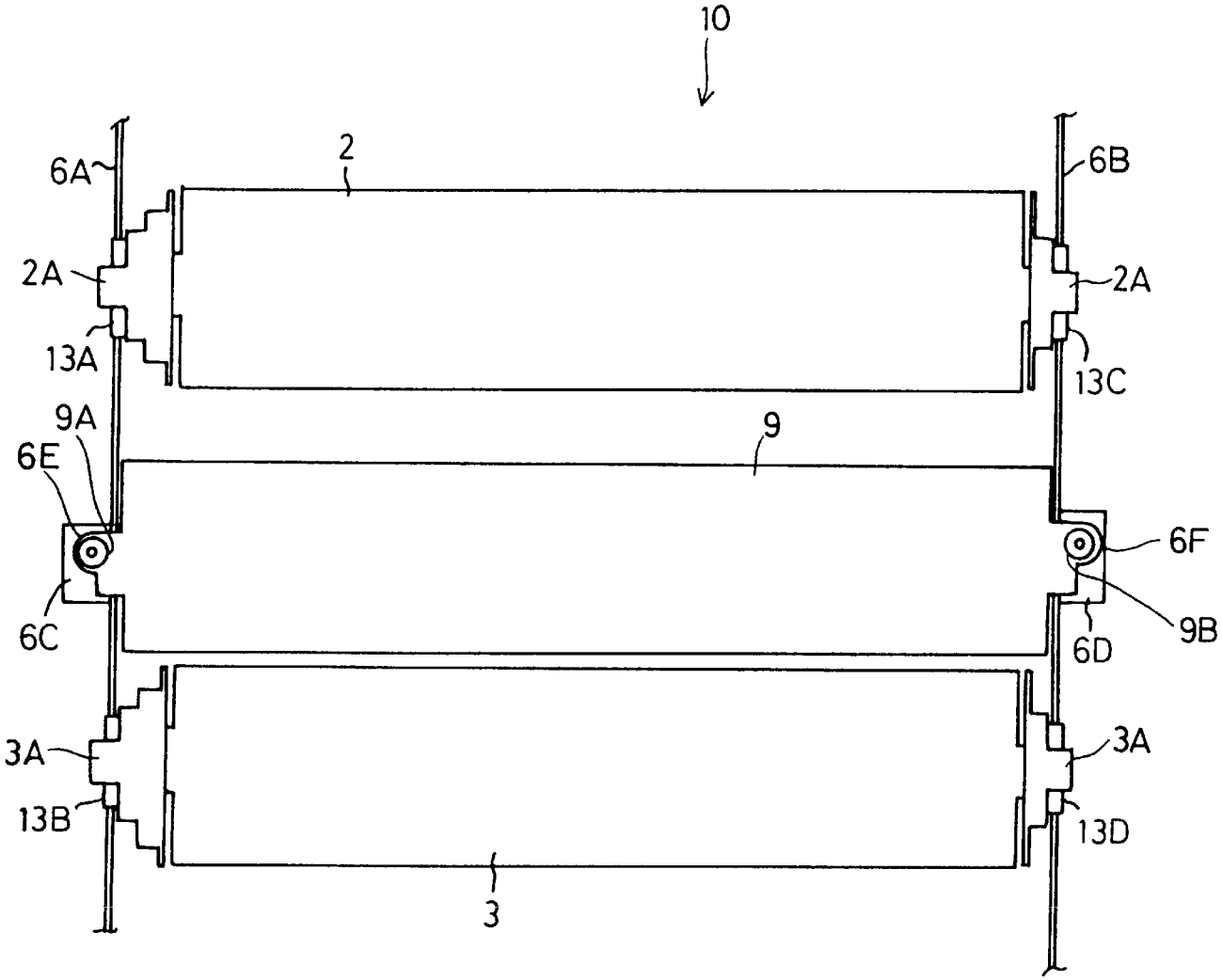
FIG. 4 is a plan view showing the arrangement of a feed roll, a take-up roll, and a recording unit of the ink ribbon feeder shown in FIG. 1.

The feed roll 2 and the take-up roll 3 are both supported approximately horizontally with respect to an unillustrated bottom plate of a facsimile apparatus by support frames 6A, 6B vertically extending from the bottom plate. The support frames 6A, 6B are plate-like members of the same shape. As shown in FIG. 4, bearings 13A, 13B are formed on the support frame 6A, and bearings 13C, 13D are formed on the support frame 6B. A spindle 2A of the feed roll 2 is supported at both ends on the bearings 13A, 13C. The spindle 3A of the take-up roll 3 is supported at both ends on the bearings 13B, 13D.

As shown in FIG. 4, a flange 6C is formed on the support frame 6A, and a flange 6D, on the support frame 6B. The flange 6C is provided with a screw hole 6E, while the flange 6D is provided with a screw hole 6F. The recording unit 9 is provided, at its both ends, with screw holes 9A, 9B, is secured by screw 15A (FIG. 6) to the support frame 6A through the screw hole 9A and the screw hole 6E, and also by screw 15B (FIG. 6) to the support frame 6B through the screw hole 9B and the screw hole 6F.

The recording unit 9 is made of an unillustrated thermal head formed in a known line shape, and is arranged such that it faces the ink ribbon 1.

Figure 1:
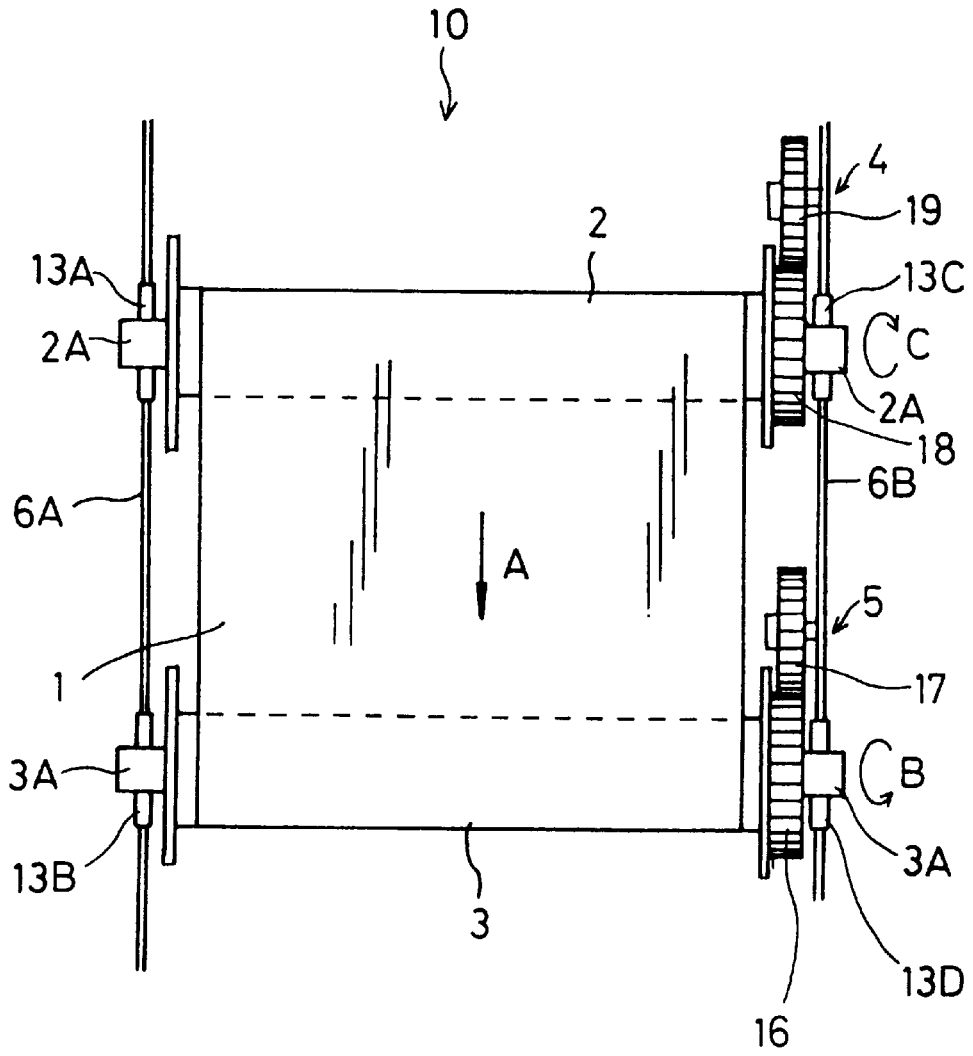
FIG. 1 is a plan view of a first embodiment of an ink ribbon feeder.
Figure 2:
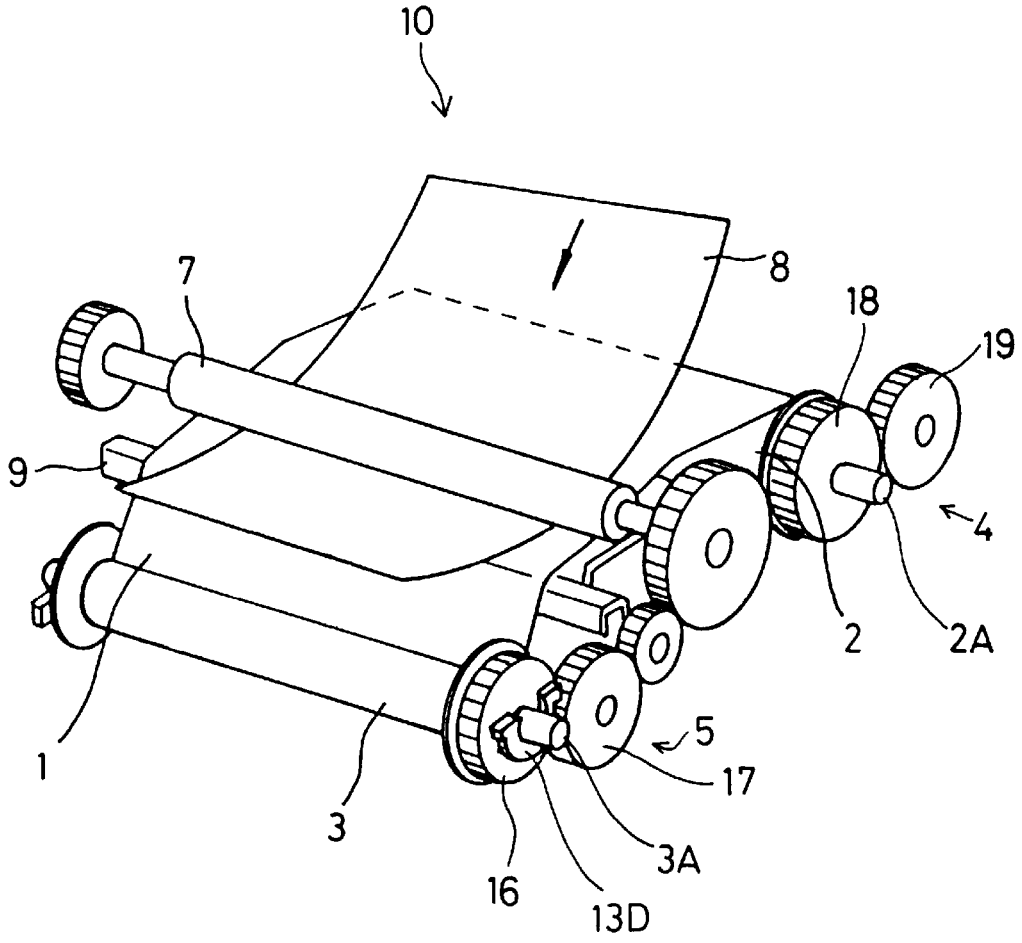
FIG. 2 is a perspective view of the ink ribbon feeder shown in FIG. 1.
Figure 3:
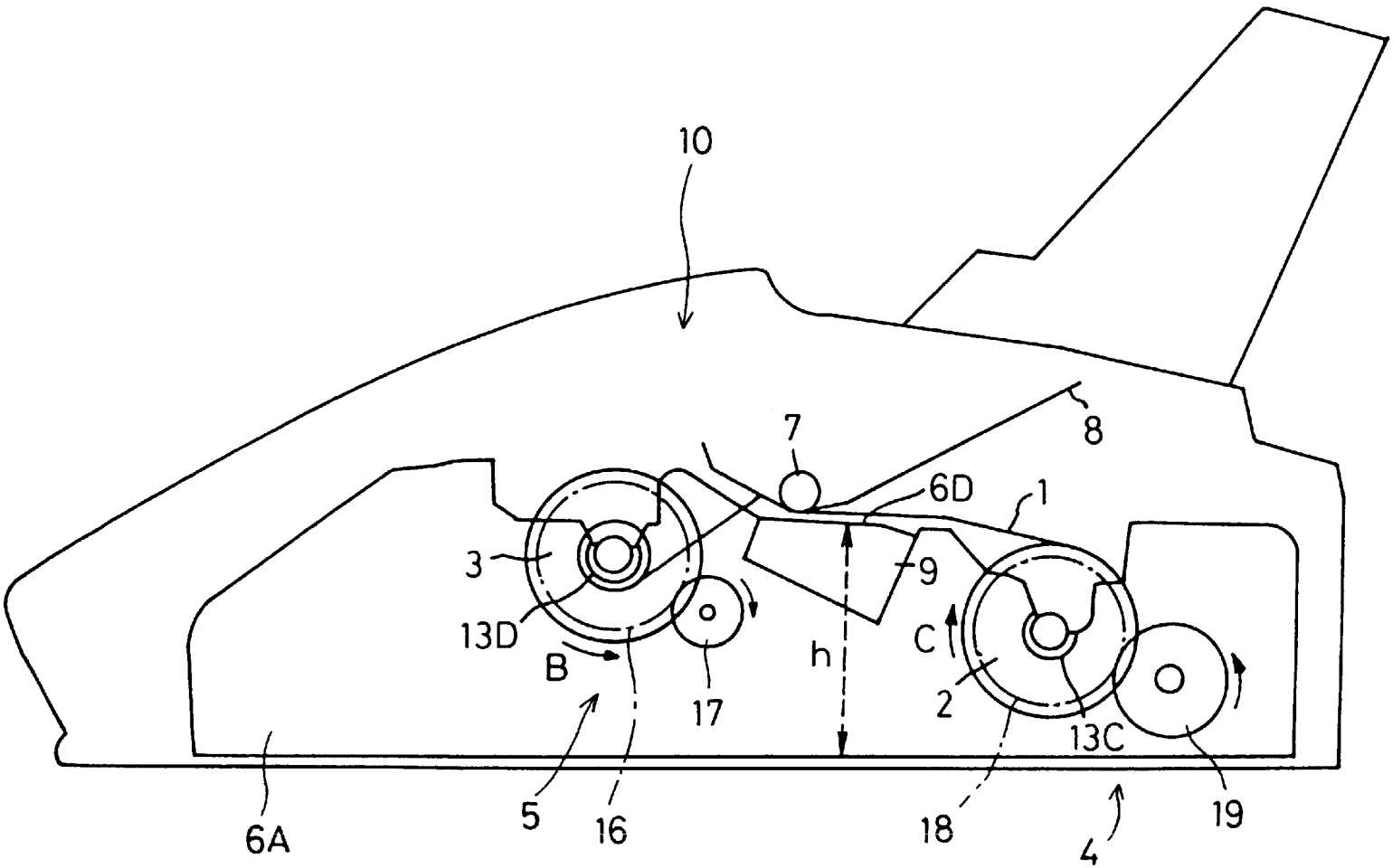
FIG. 3 is a side view of the ink ribbon feeder shown in FIG. 1.

As shown in FIGS. 2 and 3, a platen roller 7 is mounted above the ink ribbon 1, stretched between the feed roll 2 and the take-up roll 3, for carrying the paper 8 while pressing the paper 8 against the recording unit 9. Between the paper 8 and the recording unit 9 the ink ribbon 1 is present. The ink ribbon 1 is coated with ink on one side, and is wound on the feed roll 2 in such a manner that the ink-coated side will contact the paper 8.

If the thermal head of the recording unit 9 is heated according to a printing data when the paper 8 is being carried by the platen roller 7 while being pressed against the recording unit 9, the ink coated on the ink ribbon 1 is melted by the heat, and the molten ink is transferred to the paper 8, thus producing an image on the paper 8 in accordance with the printing data.

The operation to take up the ink ribbon 1 is effected by a friction mechanism 5 driving the take-up roll 3. The friction mechanism 5 has a driving gear 17 which meshes with a gear 16 which is coaxially mounted on one end (the right side in FIGS. 1 and 2) of the spindle 3A of the take-up roll 3. The driving gear 17 receives a specific driving power from a driving motor (not shown). With the rotation of the driving gear 17, the take-up roll 3 rotates in the direction of the arrow B (FIG. 1), moving the ink ribbon 1 in the direction of the arrow A (FIG. 1) to take up the ink ribbon 1 onto the take-up roll 3.

If, however, the driving gear 17 is driven at a fixed speed of rotation, the amount of the ink ribbon 1 taken up on the take-up roll 3 increases (namely, the diameter of the take-up roll 3 on which the ink ribbon 1 is being taken up increases), thereby increasing the take-up speed of the ink ribbon 1. This, however, will cause a difference between the rotational speed of the platen roller 7, carrying the recording paper, and the ink ribbon take-up speed. When a friction force exceeding a specific value thereof is exerted on the driving gear 17, or in other words when the amount of the ink ribbon 1 taken up on the take-up roll 3 has increased so much as to increase a load for turning the take-up roll 3 over a specific value, the driving gear 17 will idle to thereby absorb the difference of the rotational speed of the platen roller. The other end (the left side in FIGS. 1 and 2) of the take-up roll 3 is rotatably supported on the bearing section 13B provided on the support frame 6A, but no driving power is provided thereto.

In the meantime, there is provided a back tension mechanism 4 on the right end of the feed roll 2, or on the same side as the side where the friction mechanism 5 of the take-up roll 3 is located. The back tension mechanism 4 has a driving gear 19 which meshes with a gear 18 coaxially mounted on the right end of the spindle 2A of the feed roll 2. To the driving gear 19 is given a specific driving power for turning the feed roll 2 in the direction of the arrow C (FIG. 1) which is opposite to the direction of rotation of the take-up roll 3. The end of the feed roll 2 on the opposite side of the back tension mechanism 4 is rotatably supported only on the bearing 13A provided on the support frame 6A, and therefore does not receive the driving power.

With the driving power being imparted to the driving gear 19, the back tension mechanism 4 gives a specific turning effort to the feed roll 2 in the direction of the arrow C which is opposite to the direction of rotation of the take-up roll 3. Then, the ink ribbon 1 is applied with both a force from the friction mechanism 5 in the direction of movement (the direction of the arrow A) of the ink ribbon 1 and a force from the back tension mechanism 4 in the opposite direction (the opposite direction of the arrow A) of the ribbon movement.

Between the feed roll 2 and the take-up roll 3 the ink ribbon 1 is held with a predetermined tension by the friction mechanism 5 and the back tension mechanism 4, thereby preventing breaking and slacking of the ink ribbon 1.

In the ink ribbon feeder 10 of the first embodiment, as heretofore described, the friction mechanism 5 and the back tension mechanism 4 are arranged on the same side in the direction A of movement of the ink ribbon 1. Thus, the turning effort for taking up the ink ribbon 1 acts on the same side (the right side in the example) in relation to the direction A of movement of the ink ribbon 1. Therefore, the ink ribbon 1 will not be subjected to a twisting force likely to occur in the conventional feeder, thereby preventing the twisting force from creasing the ink ribbon 1 and consequently stabilizing the print quality.

Furthermore, since the friction mechanism 5 and the back tension mechanism 4 are arranged on the same side (the right side in the example) in the first embodiment, the driving mechanism and the gear mechanism found in the conventional feeder is unnecessary on the left side of the ink ribbon 1, and therefore it is possible to locate the support frame 6A close to the side of the ink ribbon 1. It, therefore, is possible to reduce the width of the ink ribbon feed mechanism 10, thus decreasing the size of an unillustrated ribbon cassette for holding the ink ribbon 1 and reducing the cost of the feeder.

In the first embodiment described above, the friction mechanism 5 for operation to take up the ink ribbon 1 and the back tension mechanism 4 for imparting a specific tension to the ink ribbon 1 are arranged on the same side of the ink ribbon 1. In such a device, however, there is a slight difference in tension applied to the ink ribbon 1 between the side on which the friction mechanism 5 and the back tension mechanism 4 are mounted and the side on which the mechanisms are not mounted. That is, on the side where the two mechanisms are mounted, the ink ribbon 1 is constantly applied with a fixed tension by means of the friction mechanism 5 and the back tension mechanism 4. On the other hand, on the side without the mechanisms, no tension is applied to the ink ribbon 1. Therefore, the tension on the side without the mechanisms, particularly at the edge or side of the ink ribbon 1, is less than the tension on the side provided with these mechanisms although some degree of tension goes from the side with these mechanisms to the opposite side of the ink ribbon 1. Therefore, particularly at the edge of the ink ribbon 1 on the side without the friction mechanism 5 and the back tension mechanism 4, a lack of tension will occur, causing the ink ribbon 1 to easily crease.

To cope with this drawback, the feeder has been structured, in the second embodiment hereafter described, such that not only are the friction mechanism 5 and the back tension mechanism 4 mounted on the same side but a lack of tension of the ink ribbon 1 will be corrected even on the side where the friction mechanism 5 and the back tension mechanism 4 are not provided. An example of this structure will be shown in FIGS. 5 and 6.

Figure 5:
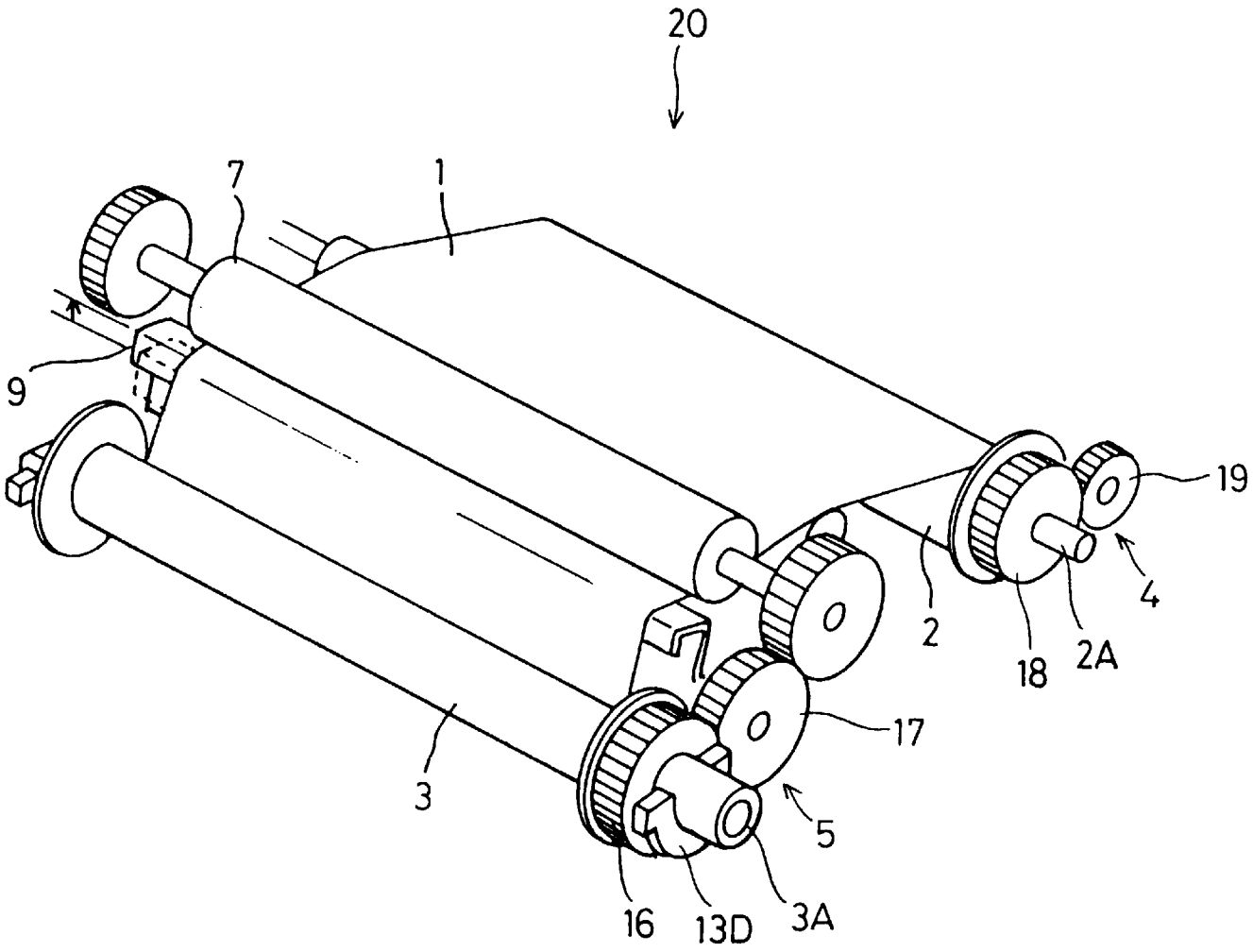
FIG. 5 is a perspective view of a second embodiment of the ink ribbon feeder.
Figure 6:
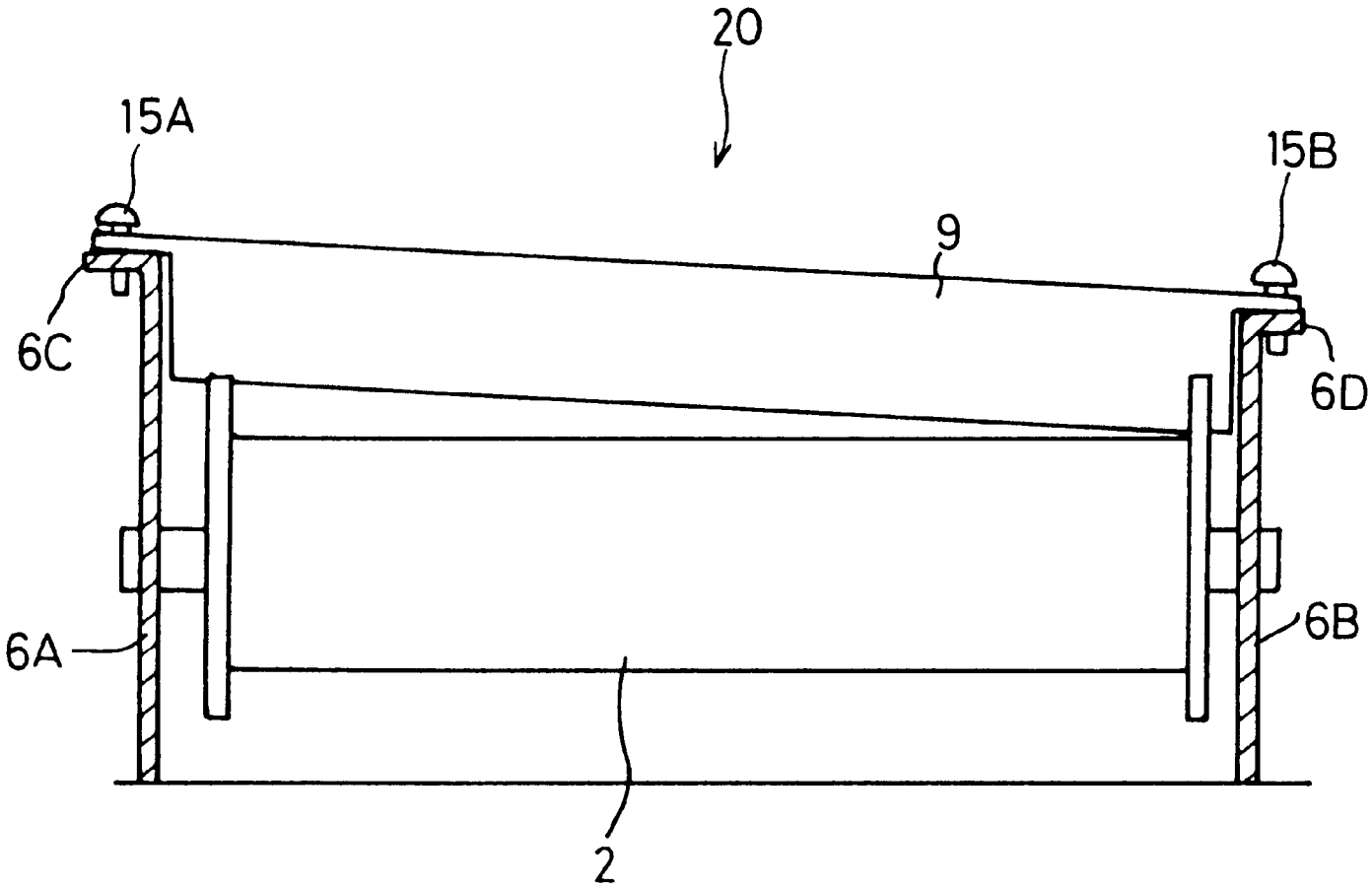
FIG. 6 is a front view of the ink ribbon shown in FIG. 5.

FIG. 5 is a perspective view of the ink ribbon feeder 20 according to the second embodiment and FIG. 6 is a front view of the same. In FIG. 6 the ink ribbon is not illustrated.

The ink ribbon feeder 20 is approximately the same in structure as that of the first embodiment, but is different in that the recording unit 9 contacts the ink ribbon 1 at a higher position on the left side than on the right side on which the friction mechanism 5 and the back tension mechanism 4 are provided.

Namely, the recording unit 9 is supported on the frames 6A, 6B, higher as it goes leftwards as viewed from the front in FIG. 6. The feed roller 2 and the take-up roller 3 are supported on the support frames 6A, 6B in such a manner that, similarly to the first embodiment, these members are approximately parallel with the bottom plate of the body of the facsimile apparatus. The platen roller 7 is supported with support frames 6A, 6B so as to be substantially parallel and in contact with the recording unit 9. This is done to ensure an even feed of the recording medium by applying a substantially uniform pressure at points between the platen roller 7 and the recording unit 9.

The support frame 6A is so formed that the flange section 6C of the support frame 6A on which side the friction mechanism 5 and the back tension mechanism 4 are not mounted will be higher than the flange section 6D of the support frame 6B on which side these mechanisms are mounted.

Therefore the ink ribbon 1 is supported in a higher position at the left end of the recording unit 9 than at the right end, thereby increasing the ink ribbon tension in the vicinity of the left edge, and accordingly correcting the difference of tension of the ink ribbon 1 from that in the vicinity of the right edge, largely reducing the possibility of occurrence of creases in the vicinity of the left edge of the ink ribbon 1. This structure enables the tension applied to the entire width of the ink ribbon 1 to be uniform.

Figure 7:
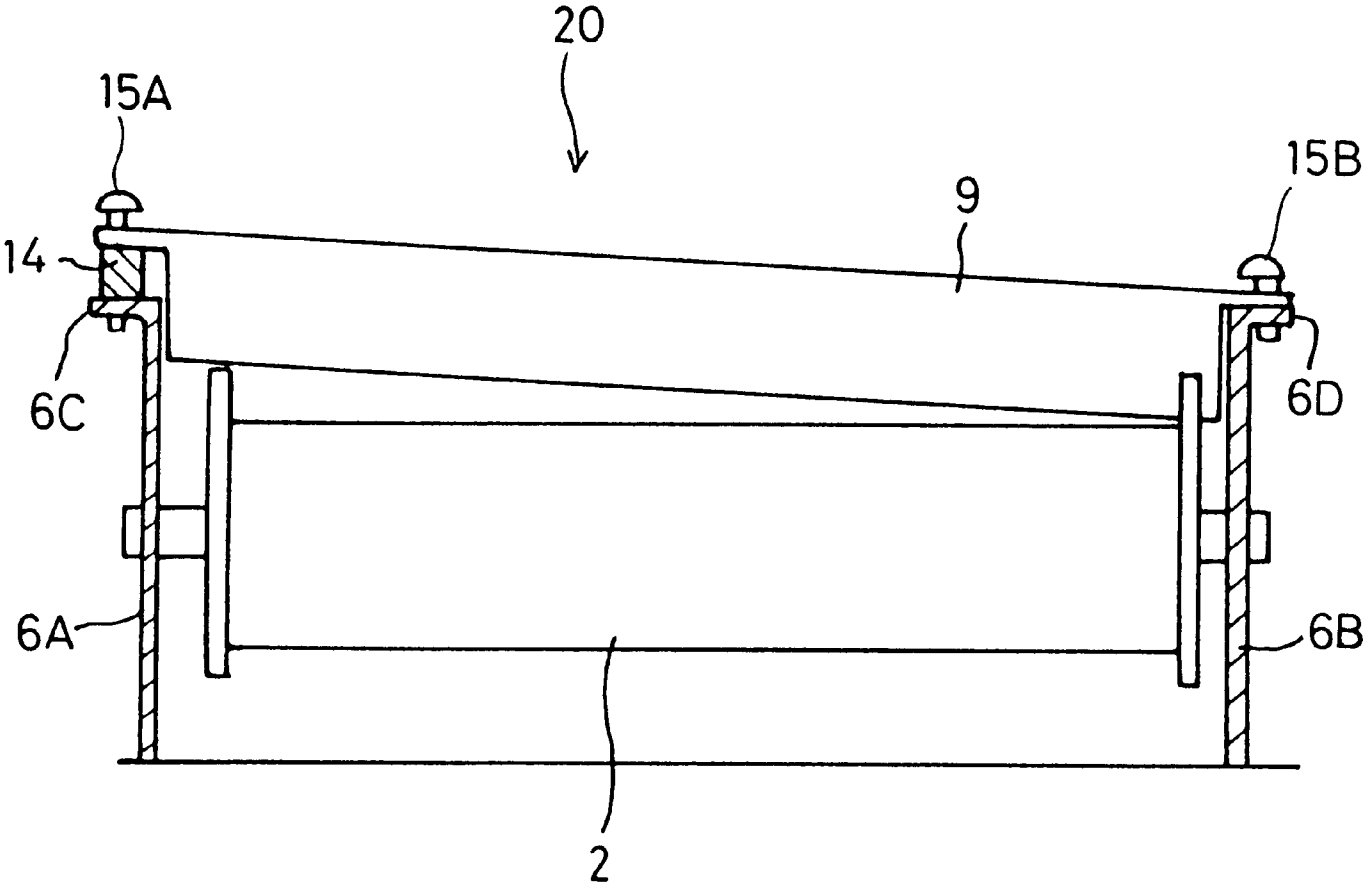
FIG. 7 is a front view of another example of the ink ribbon feeder of the second embodiment.

FIG. 7 shows a substitute way of raising the one end of the recording unit. According to this way, the support frames 6A, 6B, of the same type as those of the first embodiment, are used in place of changing the shape of the support frame 6A, such as shown in FIG. 6. A spacer 14 of suitable thickness is inserted between the flange section 6C of the support frame 6A and the left flange section of the recording unit 9, so that the recording unit 9 is higher on the left side. It is possible to correct, in this manner any lack of tension on the edge of the ink ribbon 1 adjacent to where the friction mechanism 5 and the back tension mechanism 4 are not mounted. The tension to be applied to the entire width of the ink ribbon 1 can be made more uniform, thereby largely reducing the possibility of a crease occurring. Furthermore, because the support frames 6A, 6B are plate-like members of the same configuration, the manufacturing cost for the feeder is decreased.

It is clear from a result of experiments conducted by using an approximately 218 mm wide ink ribbon 1 which is able to record on the A4-size recording paper 8 that it is preferable to increase, by 0.6 mm to 1.2 mm, the height of the side on which the friction mechanism 5 and the back tension mechanism 4 are not provided.

The third embodiment is similar to the second embodiment with respect to a feeder structure that corrects a lack of tension applied to the ink ribbon 1 on the edge where the friction mechanism 5 and the back tension mechanism 4 are not mounted and that the tension applied to the entire width of the ink ribbon 1 stretched between the feed roll 2 and the take-up roll 3 is more uniform.

Figure 8:
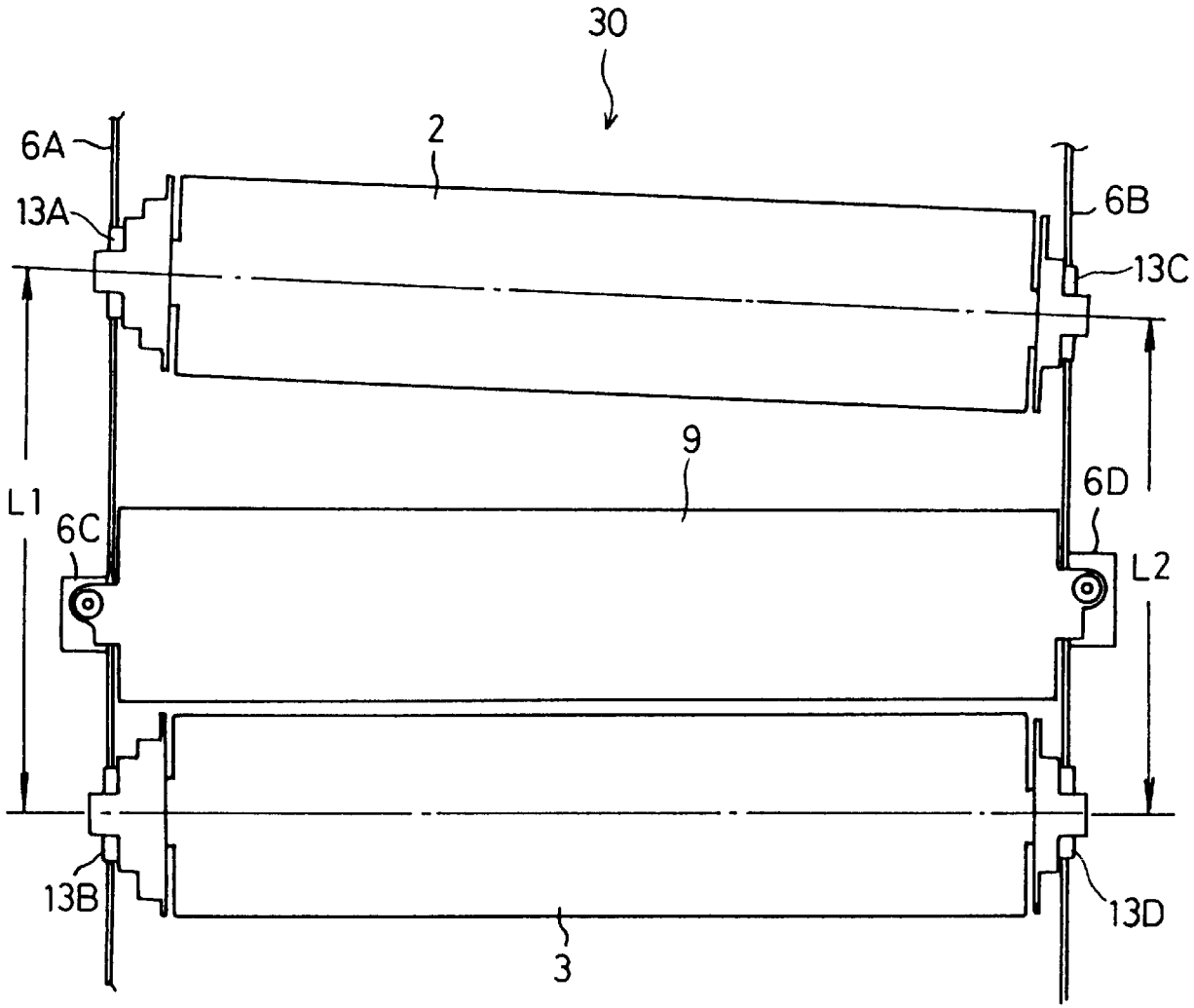
FIG. 8 is a plan view of the ink ribbon feeder of the third embodiment.
Figure 9:
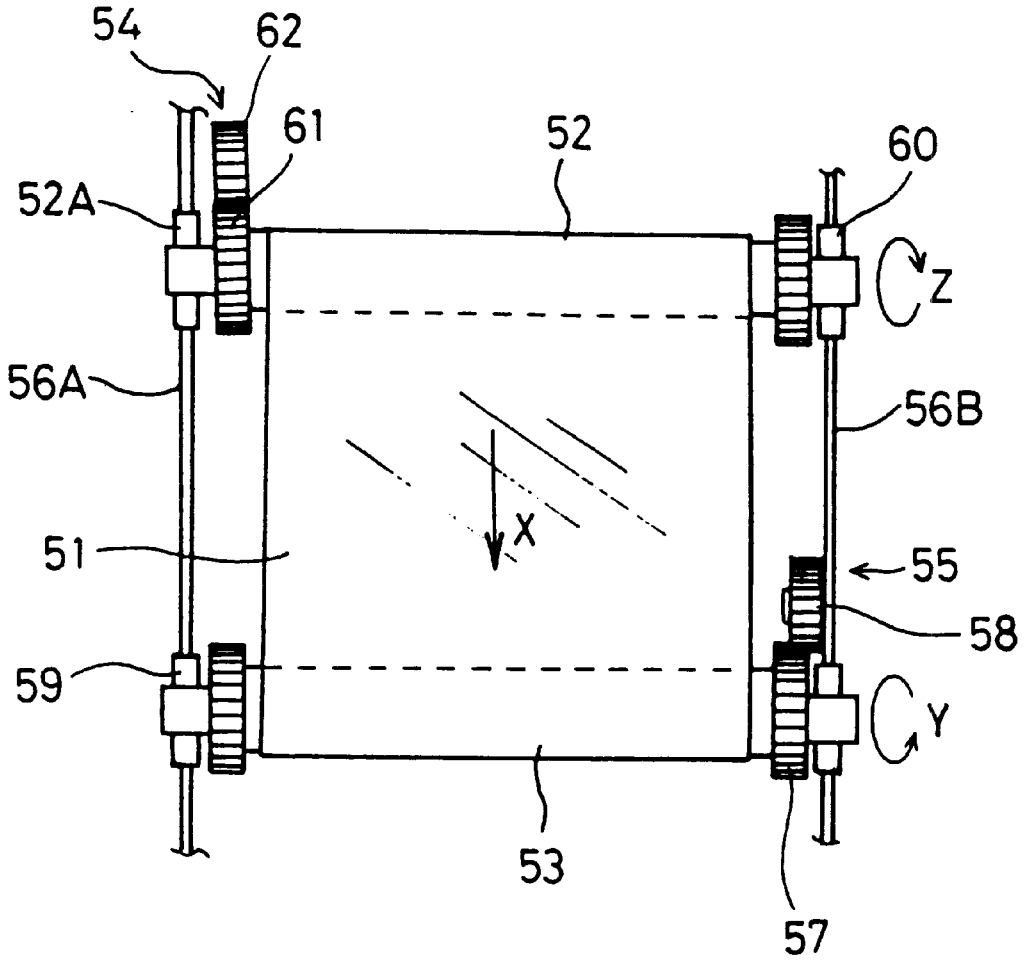
Fig.9 RELATED ART
FIG. 9 is a plan view showing a conventional ink ribbon feed mechanism.

In an ink ribbon feeder 30 of the third embodiment, the feed roll 2 and the take-up roll 3 are not mounted in a parallel, as shown in FIG. 8. The take-up roll 3 and the recording unit 9 are arranged approximately in parallel, but the feed roll 2 is disposed such that a distance between the feed roll 2 and the take-up roll 3 on the side where the friction mechanism 5 and the back tension mechanism 4 are mounted is shorter than the distance on the side where the mechanisms are not mounted. That is, a distance L2 between the feed roll 2 and the take-up roll 3 on the side where the friction mechanism 5 and the back tension mechanism 4 are mounted is shorter than a distance L1 on the side where the mechanisms are not mounted.

The above-described decrease in the distance L2 can be realized by moving the position of the bearing section 13A supporting the feed roll 2 on the support frame 6A to the rear of the position of the bearing section 13C supporting the feed roll 2 on the support frame 6B. Structurally, the left end of the feed roll 2 is moved backwards, and other take-up roll 3, recording unit 9, and platen roll 7 are held nearly in parallel with the bottom plate of the body of the facsimile apparatus, similar to the first embodiment, and the distance between the feed roll 2 and the take-up roll 3 increases on the left side of the feeder, providing an increase in the tension of the ink ribbon 1 in the vicinity of the left edge to correct any lack of tension.

Thus, it is possible to provide the tension of the portion of the ink ribbon 1 stretched between the feed roll 2 and the take-up roll 3 at a substantially uniform value, and to largely reduce the possibility of the occurrence of creases in the ink ribbon 1.

In the third embodiment in which the feed roll 2 mounted obliquely is given as an example, the feed roll 2 is supported nearly in parallel with the platen roller 7 and others, while the take-up roll 3 may be arranged diagonally, or obliquely. That is, either of the feed roll 2 and the take-up roll 3 may be arranged obliquely so long as the unwinding of the ink ribbon 1 from the feed roll 2 or the winding of the ink ribbon 1 onto the take-up roll 3 are not disturbed.

It should be noted that, in the first to third embodiments, the friction mechanism 5 and the back tension mechanism 4 arranged on the right side have been explained, and both can, of course, be arranged on the left side.

What is claimed is:

1. An ink ribbon feeder, comprising:

a feed roll support section for rotatably supporting a feed roll on which an ink ribbon is wound;

a take-up roll support section for rotatably supporting a take-up roll for taking up the ink ribbon;

a first driving section mounted on a first end of the take-up roll, and turning the take-up roll to take up the ink ribbon in a ribbon take-up direction from the feed roll to the take-up roll; and a second driving section for applying a turning force to the feed roll in an opposite direction of the take-up roll to apply a tension to the ink ribbon, the second driving section being disposed on a first end of the feed roll, the second driving section and the first driving section being on a same side of the ink ribbon in the ribbon take-up direction, the first driving section and the second driving section operating concurrently to drive their respective rolls during feed of the ink ribbon, wherein a total length of a feed of a first side edge of the ink ribbon between the feed roll and the take-up roll is shorter than a total length of a feed path of a second side edge of the ink ribbon between the feed roll and the take-up roll.

2. An ink ribbon feeder according to claim 1, further comprising:

a recording unit which contacts the ink ribbon from below, between the feed roll and the take-up roll, the recording unit having first and second ends; and a support frame for supporting the recording unit, the support frame having a first support section for supporting the first end of the recording unit on which the first driving section and the second driving section are provided, and a second support section for supporting, at a higher position than the first end of the recording unit, the second end of the recording unit on an opposite side of the ink ribbon in the ribbon take-up direction to the first support section.

3. An ink ribbon feeder according to claim 2, wherein the take-up roll support section and the feed roll support section are integrally mounted on the support frame.

4. An ink ribbon feeder according to claim 3, wherein the first support section is a vertical plate-like member supporting the first end of the recording unit at a first level, and the second support section is a vertical plate-like member supporting the second end of the recording unit at a second level which is higher than the first level.

5. An ink ribbon feeder according to claim 3, wherein the first support section is a first plate-like member having a screw hole for securing by a screw the first end of the recording unit at a first level, and the second support section comprises a second plate-like member having a screw hole and a spacer positioned between the second plate-like member and the second end of the recording unit and secured by a screw.

6. An ink ribbon feeder according to claim 2, wherein the first support section is a vertical plate-like member supporting the first end of the recording unit at a first level, and the second support section is a vertical plate-like member supporting the second end of the recording unit at a second level which is higher than the first level.

7. An ink ribbon feeder according to claim 2, wherein the first support section is a first plate-like member having a screw hole for securing by a screw the first end of the recording unit at a first level, and the second support section comprises a plate-like member having a screw hole and a spacer disposed between the second plate-like member and the second end of the recording unit, for securing by a screw the second end of the recording unit at a second level.

8. An ink ribbon feeder according to claim 1, wherein the feed roll support section has a first support section for supporting the first end of the feed roll on the second driving section side, and a second support section for supporting the second end of the feed roll, the take-up roll support section has a third support section for supporting the first end of the take-up roll on the first driving section side, and a fourth support section for supporting the second end of the take-up roll, and a distance between the second support section and the fourth support section is longer than the distance between the first support section and the third support section.

9. A printing apparatus having an ink ribbon feeder, comprising:

a first support frame;

a second support frame;

a feed roll having a first end and a second end on which an ink ribbon is wound, the feed roll rotatably supported at the first end by the first support frame and at the second end by the second support frame;

a take-up roll having a first end and a second end for taking up the ink ribbon, the take-up roll rotatably supported at the first end by the first support frame and at the second end by the second support frame;

a first drive mechanism for driving the feed roll; and a second drive mechanism for driving the take-up roll, wherein the first drive mechanism and the second drive mechanism respectively link with the first end of the feed roll and the first end of the take-up roll, the take-up roll and the feed roll disposed to provide a feed path distance along a first side edge of the ink ribbon between the rotatable support of the first end of the feed roll and the rotatable support of the first end of the take-up roll that is shorter than a feed path distance along a second side edge of the ink ribbon between the rotatable support of the second end of the feed roll and the rotatable support of the second end of the take-up roll.

10. The printing apparatus according to claim 9, wherein said first drive mechanism comprises a gear mounted to the first end of the feed roll and a driving gear engaging the gear.

11. The printing apparatus according to claim 9, wherein the second drive mechanism comprises a gear mounted to the first end of the take-up roll and a driving gear engaging the gear.

12. The printing apparatus according to claim 9, wherein a first distance between the support of the first end of the feed roll and the first end of the take-up roll in the first support frame equals a second distance between the support of the second end of the feed roll and the second end of the take-up roll in the second support frame.

13. The printing apparatus according to claim 12, further comprising a recording unit having a first end and a second end mounted at the first end to the first support frame and at the second end to the second support frame, wherein the ink ribbon is fed from the feed roll, past the recording unit and taken up on the take-up roll.

14. The printing apparatus according to claim 13, wherein the second end of the recording unit is at a greater height than the first end of the recording unit to create the shorter feed path for the first side edge of the ink ribbon.

15. The printing apparatus according to claim 14, wherein an increased height of the second support frame at least at a mount point of the second end of the recording unit relative to the first support frame provides the greater height.

16. The printing apparatus according to claim 14, wherein a spacer between a mounting point of the second end of the recording unit and the second support frame provides the greater height than at a mounting point of the first end of the recording unit to the first support frame.

17. The printing apparatus according to claim 9, wherein a first distance between the support of the first end of the feed roll and the first end of the take-up roll in the first support frame is less than a second distance between the support of the second end of the feed roll and the second end of the take-up roll in the second support frame to create the shortened feed path distance for the first side edge of the ink ribbon.

18. The printing apparatus according to claim 9, wherein the first drive mechanism drives the feed roll in a direction to resist feed of the ink ribbon and the second drive mechanism drives the take-up roll in a feed direction.

19. The printing apparatus according to claim 9, wherein the first drive mechanism and the second drive mechanism operate simultaneously during feed of the ink ribbon.

* * * * *